US007704108B2

(12) United States Patent
Oguma et al.

(10) Patent No.: US 7,704,108 B2
(45) Date of Patent: Apr. 27, 2010

(54) OUTBOARD MOTOR INCLUDING SHIFT SHAFT ROTATING MECHANISM

(75) Inventors: Takahiro Oguma, Shizuoka-ken (JP); Masahiko Kato, Shizuoka-ken (JP); Hisashi Machida, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 495 days.

(21) Appl. No.: 11/694,559

(22) Filed: Mar. 30, 2007

(65) Prior Publication Data

US 2007/0287340 A1 Dec. 13, 2007

(30) Foreign Application Priority Data

Jun. 13, 2006 (JP) ..... 2006-163764

(51) Int. Cl.
*B63H 20/20* (2006.01)

(52) U.S. Cl. ..... 440/75; 440/86

(58) Field of Classification Search ..... 440/75, 440/86

See application file for complete search history.

(56) References Cited

U.S. PATENT DOCUMENTS 5,910,191 A * 6/1999 Okamoto ..... 74/473.14
6,884,130 B2 * 4/2005 Okabe ..... 440/61 H
6,905,382 B2 * 6/2005 Ochiai et al. ..... 440/86

FOREIGN PATENT DOCUMENTS

| | | |
|---|---|---|
| JP | 05-024580 | 2/1993 |
| JP | 10-184402 | 7/1998 |
| JP | 2001-065536 | 3/2001 |
| JP | 2004-243934 | 9/2004 |
| JP | 2004-244003 | 9/2004 |
| JP | 2004-245350 | 9/2004 |
| JP | 2005-297785 | 10/2005 |

* cited by examiner

*Primary Examiner*—Ed Swinehart
(74) *Attorney, Agent, or Firm*—Keating & Bennett, LLP

(57) ABSTRACT

An outboard motor is provided that can include an exhaust guide, a shift shaft, a shift shaft rotating mechanism, and a shifting mechanism. The exhaust guide, on which an engine can be mounted, can be utilized to fix the relative positions of an axis of the shift shaft and a body of the shift shaft rotating mechanism for facilitating highly accurate and well-executed shifting of a propeller to or from one of forward and reverse rotating directions. The shift shaft can be rotatably supported by the exhaust guide, and the shift shaft rotating mechanism can be fixed to the exhaust guide. Further, the shift shaft rotating mechanism can be configured to selectively rotate the shift shaft.

20 Claims, 6 Drawing Sheets

OUTBOARD MOTOR INCLUDING SHIFT SHAFT ROTATING MECHANISM

CROSS-REFERENCE TO RELATED APPLICATIONS

The present application is based on and claims priority under 35 U.S.C. §119 to Japanese Patent Application No. 2006-163764, filed on Jun. 13, 2006, the entire contents of which is expressly incorporated by reference herein.

BACKGROUND

1. Field of the Inventions

The present inventions generally relate to an outboard motor that provides a thrust to a watercraft by rotating a propeller using engine power, and more particularly, to an improvement of a shift shaft rotating mechanism to facilitate highly accurate and well-executed shifting of a propeller between neutral, forward, and reverse rotating directions.

2. Description of the Related Art

Japanese Patent Application Publication Nos. JP-A-Hei 5-24580, JP-A-Hei 10-184402, JP-A-2001-65536, JP-A-2004-243934, JP-A-2004-244003, JP-A-2004-245350, and JP-A-2005-297785 each describes an outboard motor that is mounted on the stern of a hull and provides thrust to a watercraft by rotating a propeller using engine driving power. The engine is disposed in an upper portion of the outboard motor, and drives the propeller disposed in a lower portion of the outboard motor through a drive shaft and a propeller shaft. The drive shaft extends vertically downward from the engine. The propeller shaft extends horizontally rearward to the propeller. A shifting device that transmits a driving force from the drive shaft to the propeller shaft is provided between the drive shaft and the propeller shaft (in particular, see Japanese Patent Application Publication Nos. JP-A-2001-65536 and JP-A-2005-297785).

Typically, the shifting device includes a forward bevel gear and a reverse bevel gear, both being provided on the outer surface of the propeller shaft. As the shift shaft rotates, one of the bevel gears meshes with a gear on a lower end of the drive shaft, or both of the bevel gears separate from the gear on the lower end of the drive shaft, thereby performing gear shifting to one of the forward, neutral, and reverse positions. The engine is mounted on the exhaust guide (e.g., reference numeral 28 of JP-A-Hei 5-24580), and the engine is covered with a top cowling.

JP-A-2005-297785 also describes an outboard motor having a shift actuator for rotating a shift shaft (see paragraph [0050] and FIG. 4 of JP-A-2005-297785). The shift actuator swings a shift arm with a driving power of a motor, and also advances and retracts a shift slider using a link rod that is placed between the shift slider and the shift shaft. In this regard, the shift slider advances and retracts the link rod to rotate the shift shaft.

SUMMARY OF THE INVENTIONS

Prior outboard motors are configured such that a rotational support of the shift shaft is fixed to the exhaust guide and the shift actuator is fixed to the top cowling that covers the engine. Accordingly, an aspect of at least one of the embodiments disclosed herein includes the realization that a relative positional relationship between the rotational support of the shift shaft and the shift actuator varies, which makes it difficult to attach the shift actuator to a predetermined position with high accuracy. In addition, another aspect of at least one of the embodiments includes the realization that the outboard motor must be provided with an adjuster for adjusting the positional relationship to ensure positional accuracy in attachment of the shift actuator. Finally, yet another aspect of at least one of the embodiments includes the realization that prior art outboard motors are also disadvantageous in that, because the advancing and retracting motion of the link rod is attained by swinging the shift arm, the shift arm undergoes bending stress, which decreases its durability.

In accordance with at least one embodiment of the present inventions, an outboard motor is provided that comprises a shift shaft rotating mechanism for rotating a shift shaft, wherein the shift shaft rotating mechanism is attachable to a predetermined position of the outboard motor to provide highly accurate and well-executed shifting of a propeller to or from one of neutral, forward, and reverse rotating directions. In an embodiment, the outboard motor can include an exhaust guide, on which an engine can be mounted; in this regard, the exhaust guide can be used to fix the relative positions of an axis of the shift shaft and a body of the shift shaft rotating mechanism for facilitating highly accurate and well-executed shifting of the propeller to or from one of the forward and reverse rotating directions.

An embodiment of the outboard motor can include an exhaust guide, a shift shaft, a shift shaft rotating mechanism, and a shifting mechanism. The exhaust guide, on which an engine can be mounted, can guide exhaust gases out of the engine. The shift shaft can be rotatably supported by the exhaust guide, and can extend vertically downward from the exhaust guide. The shift shaft rotating mechanism can be fixed to the exhaust guide, and can rotate the shift shaft. The shifting mechanism can switch a rotating direction of a propeller in response to the rotation of the shift shaft.

According to an embodiment, the shift shaft rotating mechanism can be fixed to the exhaust guide that supports the shift shaft. In this regard, a constant relative positional relationship can be established between the shift shaft and the shift shaft rotating mechanism. Hence, attachment of the shift shaft rotating mechanism to a predetermined position can be attained with high accuracy.

In another embodiment, the shift shaft rotating mechanism can include an actuator bracket and a shift actuator. The actuator bracket can be fixed to the exhaust guide. The shift actuator can be fixed to the actuator bracket, and can rotate the shift shaft.

In such an embodiment, because the shift actuator can be fixed to the exhaust guide with the actuator bracket therebetween, the shift actuator is subjected to significantly reduced levels of heat and vibrations from the engine. In addition, mounting the shift actuator can be facilitated.

In another embodiment, the shift actuator can include an actuator rod and a rod drive mechanism. The actuator rod can be coupled to the shift shaft, and the rod drive mechanism can advance and retract the actuator rod in its axial direction. The actuator bracket can include a holder that can hold the shift actuator and a guide that can guide the actuator rod.

In such an embodiment, because the actuator bracket can include the holder and the guide, the shift actuator and the actuator rod can be positioned easily and with high accuracy.

In still another embodiment, the shift shaft rotating mechanism can further include a lever shift rod placed between the actuator rod and the shift shaft. The lever shift rod can extend out of the actuator rod in the axial direction thereof and can extend to the shift shaft.

In such an embodiment, since the lever shift rod can extend out in the axial direction of the actuator rod, when the actuator rod advances and retracts in its axial direction, the lever shift rod can also advance and retract in conjunction with the actuator. Hence, the bending stress on the lever shift rod can be minimized and/or eliminated, thus improving the longevity of the lever shift rod.

In still another embodiment, the engine can have an intake manifold attached to a side surface of the engine. The shift actuator can be disposed below the intake manifold. The shift shaft can be located on a widthwise center line of the outboard motor and in front of a drive shaft that can transmit a driving force from the engine to the shifting mechanism. The shift shaft rotating mechanism can further include a shift arm. The shift arm can be fixed to an upper end of the shift shaft, and can extend generally horizontally. The lever shift rod can be bow-shaped and can extend along the side surface of the engine. One end of the lever shift rod can be rotatably attached to an end of the actuator rod. The other end of the lever shift rod can be rotatably attached to an end of the shift arm.

In such an embodiment, the shift actuator and shift arm can be positioned externally and compactly to the engine, thereby conserving space and not requiring that the conventional layout of an engine and/or motor be changed.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

The following is a description of embodiments that are arranged and configured in accordance with certain features, aspects and advantages of the present inventions. This description makes reference to FIGS. 1-6. As shown therein, FIGS. 1-6 illustrate an embodiment of an outboard motor comprising a shift shaft rotating mechanism for rotating a shift shaft, in which the shift shaft mechanism is attachable to a predetermined position of the motor to facilitate highly accurate shifting. The embodiments disclosed herein are described in the context of a marine propulsion system of a watercraft because these embodiments have particular utility in this context. However, the embodiments and inventions herein can also be applied to other marine vessels, personal watercraft, boats, such as small jet boats, as well as other land and marine vehicles. It is to be understood that the embodiments disclosed herein are exemplary but non-limiting embodiments, and thus, the inventions disclosed herein are not limited to the disclosed exemplary embodiments.

As used herein, it is contemplated that parts can be fixed, coupled, and/or attached to each other either removably or permanently, due to the configuration of the parts, by using mechanical fastening means, and/or by using joining materials/operations. For example, bolts, screws, glues, welding, special configurations that facilitate interconnection of parts, pressure fits, clips, and any other such means for fixing two parts to each other can be used.

Figure 1:
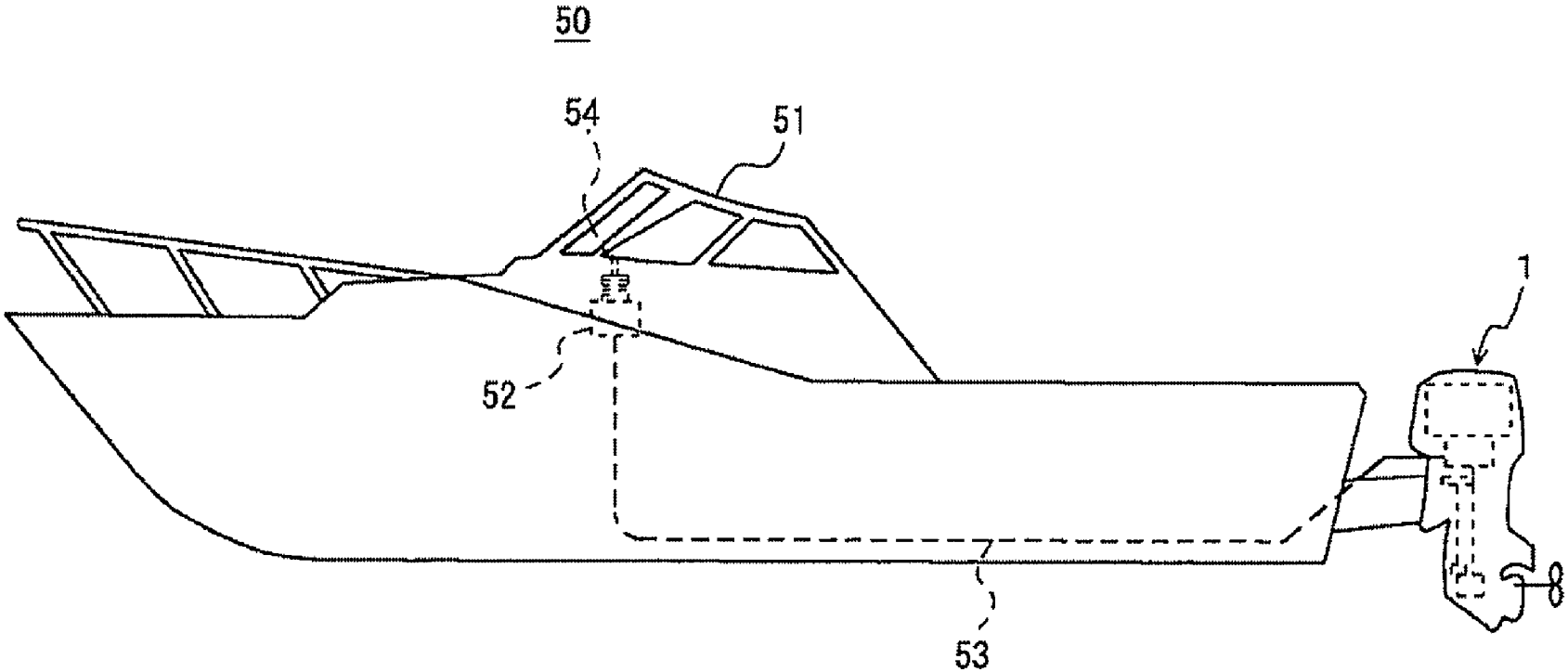
FIG. 1 is a side view of a watercraft with an outboard motor mounted thereon, according to an embodiment that is arranged and configured in accordance with certain features, aspects and advantages of the present inventions.

With reference now to the figures, FIG. 1 illustrates an embodiment of an outboard motor 1 that is attached to the stern of a watercraft 50. The watercraft 50 can have a cockpit 51 in a center area thereof from which the watercraft can be operated. A remote controller 52 can be disposed in the cockpit 51 for controlling the motor 1. An ECU (Electronic Control Unit) in the remote controller 52 can be connected to an ECU in the outboard motor 1 by a network cable 53. Accordingly, an operator can thus operate a shift lever 54 of the remote controller 52 to shift gears (to a forward, a neutral, or a reverse position) of the outboard motor 1.

Figure 2:
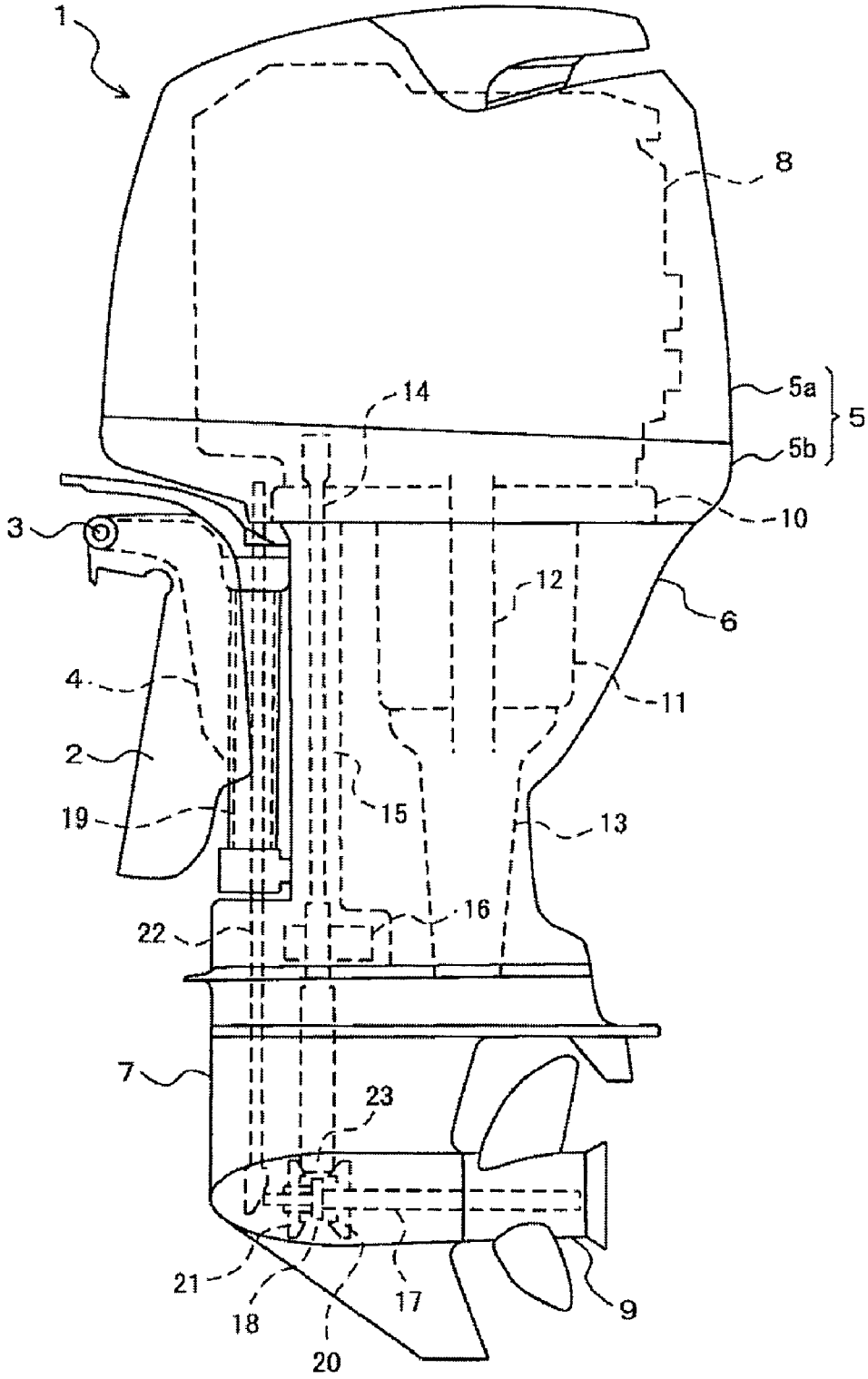
FIG. 2 is a side view of the outboard motor shown in FIG. 1.

With reference to FIG. 2, the outboard motor 1 can be attached to the watercraft 50 using attachment means such as a clamp bracket 2 and a swivel bracket 4. For example, the clamp bracket 2 can be attached to a transom board of the watercraft 50. Further, the swivel bracket 4 can be journaled about a horizontally-extending tilt shaft 3. In some embodiments, the swivel bracket 4 can also be used to support a vertically-extending steering shaft 19. Thus, such an embodiment of the outboard motor 1 can selectively tilt and swivel.

In accordance with another aspect of this embodiment, the outboard motor 1 can include an engine 8, such as a water-cooled DOHCV engine. The engine 8 can be mounted in an upper portion of the outboard motor 1 and can be covered with a top cowling 5. The engine 8 can be placed and fixed onto the exhaust guide 10, for example, using a bolt or other fastening means known in the art. The top cowling 5 can be formed with an upper cowling member 5*a* and a bottom cowling member 5*b*, and can be attached to the exhaust guide 10. Furthermore, in some embodiments, a cushioning material such as rubber can be positioned between the cowling members 5*a*, 5*b*.

Referring still to FIG. 2, the outboard motor 1 can be configured to include an upper casing 6, a lower casing 7, an oil pan 11, and an exhaust pipe 12. The upper casing 6 can be fixed to a lower surface of the exhaust guide 10, and the lower casing 7 can be fixed to a lower surface of the upper casing 6. The oil pan 11 can be disposed in the upper casing 6 and can be utilized to reserve lubricant for use by the engine 8. For example, the oil pan 11 can be fixed to the lower surface of the exhaust guide 10. The exhaust pipe 12 can extend through the oil pan 11 and can guide exhaust gases out of the engine 8 to the exhaust pipe 12. In particular, the exhaust pipe 12 can guide the exhaust gases to an exhaust passage 13 provided below the oil pan 11.

The outboard motor 1 can be configured to include a drive shaft chamber 15. The drive shaft chamber 15 can be defined in the upper casing 6 of the motor 1 with a drive shaft 14 extending therethrough. The engine 8 can include a plurality of cylinders (not shown) that can be aligned in a generally upright orientation, and a crank shaft (not shown), which can be oriented generally vertically. The drive shaft 14 can be coupled to the crank shaft and can extend downward from the engine 8. Furthermore, the motor 1 also can include a water pump 16 that can be mounted, for example, on the bottom of the upper casing 6. The pump 16 can be used to pump water from inside the lower casing 7, and to supply the water as cooling water to the engine 8.

As also shown in FIG. 2, the outboard motor 1 can also include a gear assembly, a propeller shaft 17, and a shifting mechanism 18 that can facilitate transfer of driving force to a propeller 9. In an embodiment, the lower casing 7 of the outboard motor 1 can be configured such that the propeller shaft 17 is oriented generally horizontally when the outboard motor 1 is positioned in a generally upright position. The shifting mechanism 18 can be coupled to a front end of the propeller shaft 17, such as on an outer surface thereof. In addition, forward and reverse bevel gears 20, 21, can be provided and can meshingly engage the drive shaft 14, for example, by the use of a bevel gear 23 that can be attached to a lower end of the drive shaft 14. For example, the propeller shaft 17 can be a splined shaft, and the shifting mechanism 18 can be a collar that can axially translate along the propeller shaft 17 to engage the gears 20, 21 to cause the driving force of the drive shaft 14 to be transmitted to the propeller shaft 17. Finally, a rear end of the propeller shaft 17 can coupled to the propeller 9, thus allowing the driving force to be transmitted from the drive shaft 14 through the shifting mechanism 18 to the propeller shaft 17 and to the propeller 9.

Figure 3:
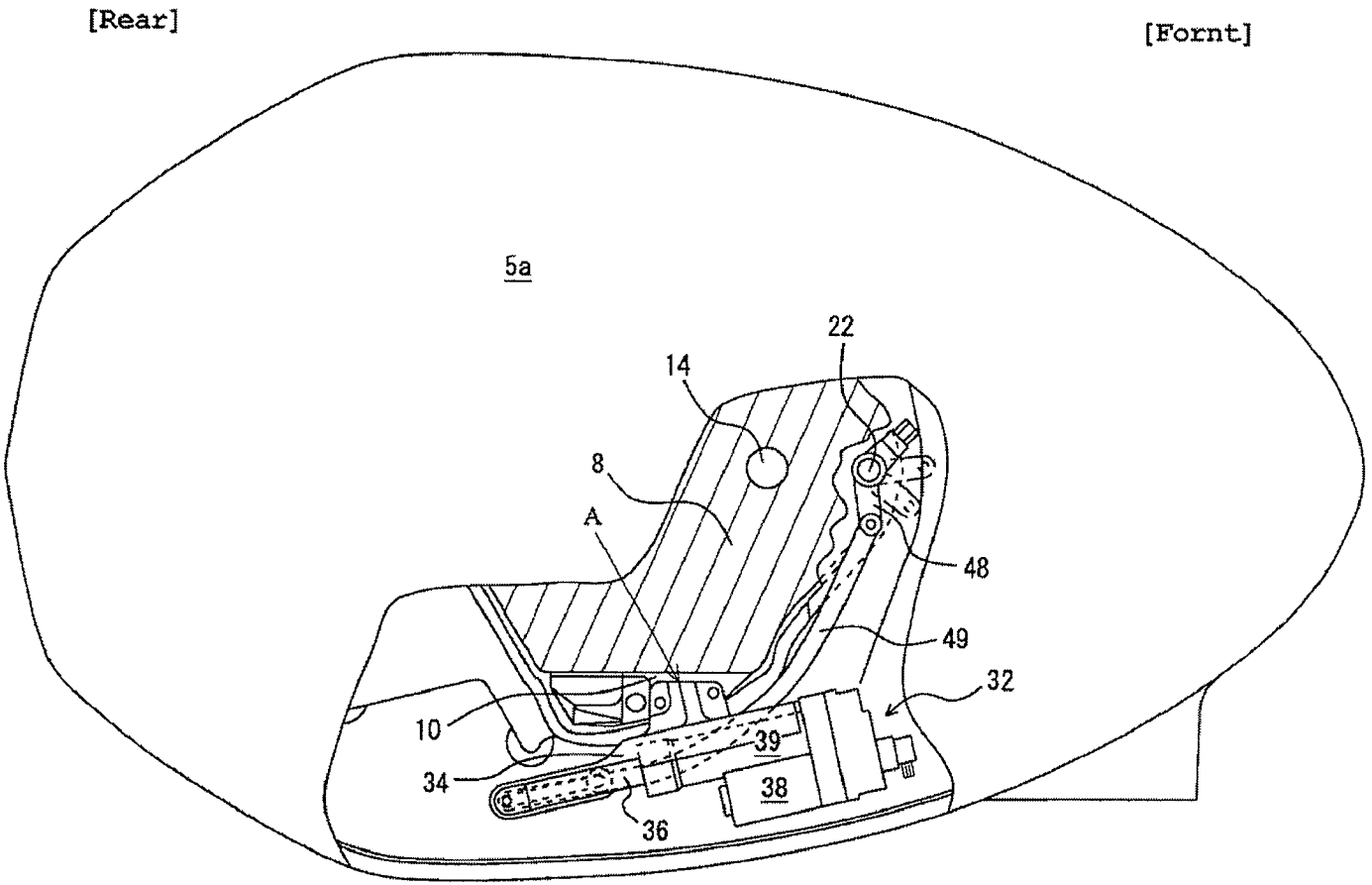
FIG. 3 is a partially-cutaway top view of the outboard motor shown in FIG. 1.
Figure 4:
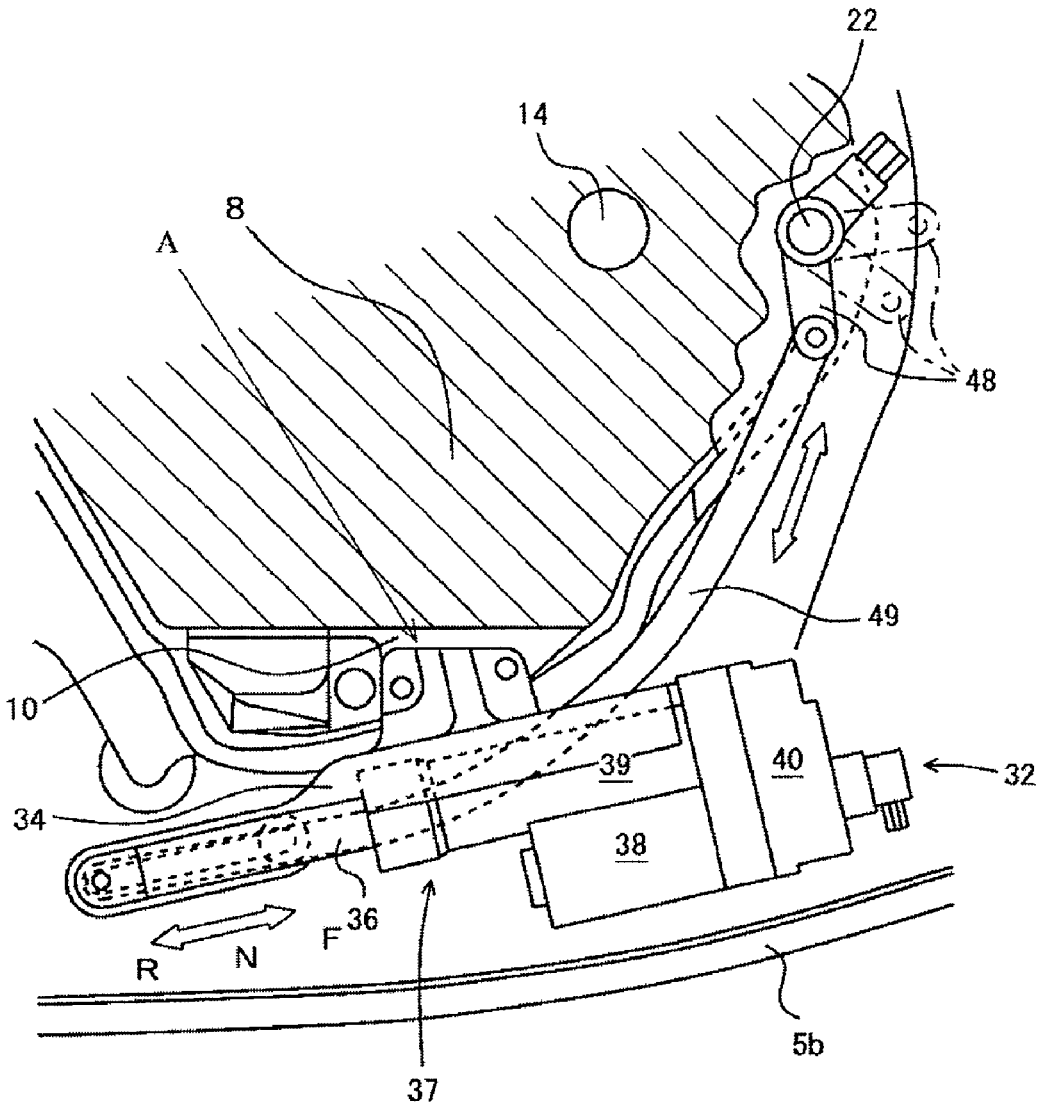
FIG. 4 is a sectional top view of the outboard motor shown in FIG. 1.

The outboard motor 1 can also include a shift shaft 22 that can extend from the bottom cowling member 5*b* to the lower casing 7. In some embodiments, the shift shaft 22 can pass through the steering shaft 19. As illustrated in FIGS. 3-4 in cutaway view, the shift shaft 22 can be rotatably supported by the exhaust guide 10, and can extend vertically downward therefrom. An axis of the shift shaft 22 thus can be in a fixed location relative to the exhaust guide 10. The shift shaft 22 can be rotated by a shift actuator 32, which will be described in detail further below. In this regard, rotation of the shift shaft 22 can cause the shifting mechanism 18 to mesh with one of the forward bevel gear 20 and the reverse bevel gear 21 to thereby transmit a driving force to the propeller shaft 17. Hence, gear shifting of the outboard motor 1 to one of a forward, a reverse, and a neutral position is attained.

Figure 5:
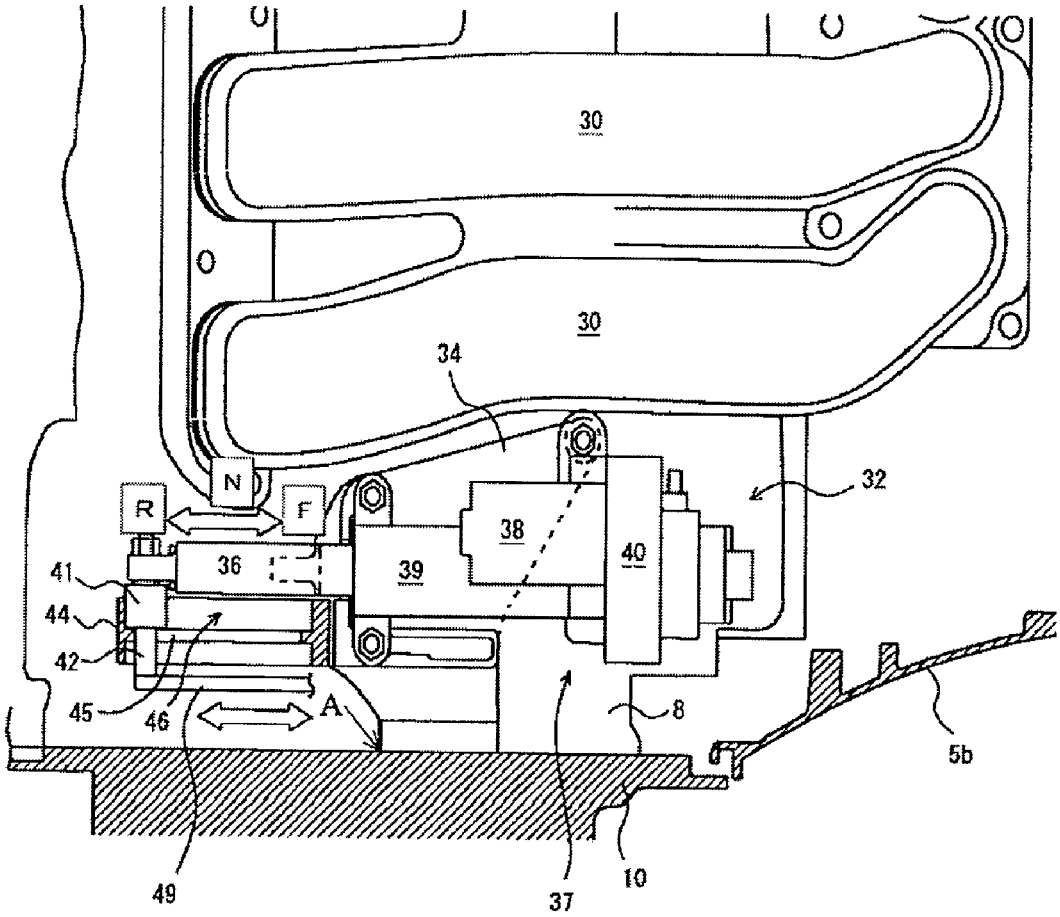
FIG. 5 is a sectional side view of the outboard motor shown in FIG. 1.

With reference now to FIGS. 3-5, a shift shaft rotating mechanism for rotating the shift shaft 22 now will be described. FIG. 3 is a partially-cutaway top view of the outboard motor 1. FIG. 4 is an enlarged top view of an essential portion of the outboard motor 1. FIG. 5 is a side view of the same. The fore-and-aft direction of FIGS. 3 to 5 is opposite from that of FIG. 2. As described further below, the exhaust guide 10, on which an engine 8 can be mounted, can be used to fix the relative positions of an axis of the shift shaft 22 and a body of the shift shaft rotating mechanism for facilitating highly accurate and well-executed shifting of the propeller 9 to or from one of forward and reverse rotating directions.

FIG. 5 illustrates that an intake manifold 30 can be attached to a right side surface of the engine 8. In some embodiments, the shift actuator 32 can be disposed below the intake manifold 30. An actuator bracket 34 can be fixed to the upper surface of the exhaust guide 10 with one or more fastener, such as a bolt or the like (such as portions denoted by A in FIGS. 3 to 5). Further, the shift actuator 32 can be fixed to the actuator bracket 34.

In accordance with an embodiment of the shift shaft rotating mechanism, the shift actuator 32 can include an actuator rod 36 and a rod drive mechanism 37. The actuator rod 36 can be substantially cylindrical in shape. Further, the drive mechanism 37 can be configured to advance and retract the actuator rod 36 in its axial direction. In an embodiment, the rod drive mechanism 37 can include an electric motor 38, a cylinder 39 that slidably houses the actuator rod 36, and a gear case 40 that can transmit a driving force from the electric motor 38 to the actuator rod 36. A guide bushing 41, which can be generally cylindrical in shape, can be journaled upright about a pin 42 at the front end of the actuator rod 36. A threaded rod (not shown) can be coaxially coupled to the rear end of the actuator rod 36, and housed in the cylinder 39. A gear (not shown) that is meshed with the threaded rod can be positioned in the gear case 40 to move the threaded rod in the axial direction of the rod, and to thereby move the actuator rod 36 in the axial direction as well.

Figure 6:
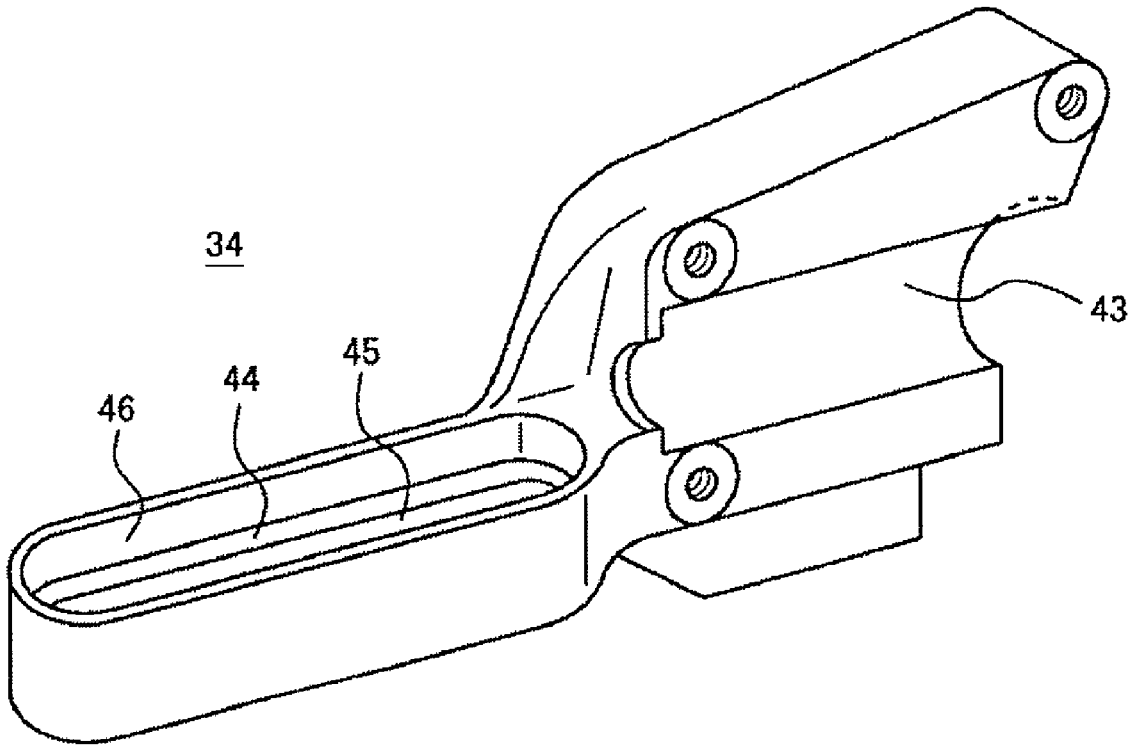
FIG. 6 is a perspective view of an actuator bracket.

As shown in FIG. 6, the actuator bracket 34 of the shift shaft rotating mechanism can include a holder 43 and a guide 44. In some embodiments, the actuator bracket 34 is formed as one piece, although separate portions can be combined to form the actuator bracket 34. The holder 43 can comprise a recessed region or can include an opening so as to hold the actuator 32 therein. The guide 44 can be configured to guide the actuator rod 36. To that end, a generally linear guide slit 45 can be formed in the guide 44 for guiding the pin 42. The outboard motor 1 can include a guide wall 46 that houses and guides the guide bushing 41. In this regard, the guide wall 46 can be formed around the guide slit 45. The holder 43 can receive the cylinder 39 of the shift actuator 32, and the shift actuator 32 can be fixed to the actuator bracket 34 with a fastener, such as a bolt or the like.

With reference to FIGS. 3-5 again, the illustrated embodiment shows that the shift shaft 22 can be located on a widthwise center line of the outboard motor 1 and in front of the drive shaft 14. The shift shaft 22 can extend through the exhaust guide 10 with an upper end of the shift shaft 22 exposed out of the upper surface of the exhaust guide 10. A horizontally-extending shift arm 48 can be fixed to the upper end of the shift shaft 22.

The outboard motor 1 can also comprise a lever shift rod 49 that can be placed between the actuator rod 36 and the shift shaft 22. The lever shift rod 49 can extend from the actuator rod 36 in the axial direction thereof toward the shift shaft 22. In this regard, one portion, such as one end, of the lever shift rod 49 can be rotatably attached to the actuator rod 36, such as at the front end of the actuator rod 36, and the other end of the lever shift rod 49 can be rotatably attached the shift arm 48, such as to the end of the shift arm 48. More specifically, the lever shift rod 49 can be disposed below the guide 44 of the actuator bracket 34, and coupled to the pin 42 at the end of the lever shift rod 49 and to the shift arm 48. Furthermore, as shown in FIG. 3, the lever shift rod 49 can be bow-shaped or slightly bent in configuration; however, the lever shift rod 49 can also be formed from two or more linear segments. Other configurations of the lever shift rod 49 are also contemplated.

As discussed above, an embodiment of the shift shaft rotating mechanism can comprise the above-mentioned shift actuator 32, the actuator bracket 34, the shift arm 48, and the lever shift rod 49, and can be used for rotating the shift shaft 22. Operation of an embodiment of the shift shaft rotating mechanism will now be described.

In order to cause the propeller 9 to rotate in a direction for moving the watercraft 50 forward, the operator can use the shift lever 54. For example, the shift lever 54 can be tilted forward to trigger the following exemplary operation: the ECU causes the electric motor 38 to rotate in a forward direction; the forward rotation of the electric motor 38 causes the shift actuator 32 to start pulling the actuator rod 36 into the cylinder 39; the actuator rod 36 moves forward to thereby push and move the lever shift rod 49; the lever shift rod 49 then swings the shift arm 48 and causes the shift shaft 22 to rotate in a forward direction; as a result of the forward rotation of the shift shaft 22, the shifting mechanism 18 is meshed with the forward bevel gear 20; and finally, the meshing engagement of the shifting mechanism 18 with the forward bevel gear 20 transmits a driving force from the drive shaft 14 to the propeller shaft 17 to rotate the propeller 9 in a direction to move the watercraft 50 forward.

In contrast, to cause the propeller 9 to rotate in a direction for moving the watercraft 50 rearward in the illustrated embodiment, the operator can tilt the shift lever 54 rearward to trigger the following exemplary operation: the ECU causes the electric motor 38 to rotate in a reverse direction; the reverse rotation of the electric motor 38 causes the shift actuator 32 to start pushing the actuator rod 36 out of the cylinder 39; the actuator rod 36 moves rearward to pull the lever shift rod 49; the lever shift rod 49 moves to swing the shift arm 48 and cause the shift shaft 22 to rotate in a reverse direction; as a result of the reverse rotation of the shift shaft 22, the shifting mechanism 18 is meshed with the reverse bevel gear 21, and a driving force is transmitted to the propeller shaft 17 to rotate the propeller 9 in a direction to move the watercraft 50 rearward.

In addition, in the illustrated embodiment, the shift lever 54 can be returned to a neutral position from a forward or reverse position such that the actuator rod 36 is stopped at a position between the above-mentioned forward and reverse positions. Accordingly, the shift shaft 22 can also be stopped at a position between the forward and reverse positions, and the shifting mechanism 18 can be stopped at a neutral position where the mechanism 18 is separated from the forward bevel gear 20 and the reverse bevel gear 21.

According to at least one of the disclosed embodiments, both the shift shaft 22 and the shift actuator 32 can be fixed to the exhaust guide 10, and a relative positional relationship between the shift shaft 22 and the shift actuator 32 can be held substantially constant. Hence, such embodiments can provide attachment of the shift actuator 32 to a predetermined position with high accuracy without requiring an adjuster.

Furthermore, an aspect of at least one of the embodiments disclosed herein includes the realization that because both the shift shaft 22 and the shift actuator 32 can be fixed to the exhaust guide 10, assembly and maintenance of the motor 1 can be simplified. For example, when the engine 8 is attached to and detached from the exhaust guide 10 during assembly or maintenance of the outboard motor 1, the shift shaft 22 need not be decoupled from the shift actuator 32, thus improving the workability.

Further, because the shift actuator 32 can be fixed to the exhaust guide 10 with at least the actuator bracket 34 being coupled thereto between the shift actuator 32 and the engine 8, the shift actuator 32 may hardly subjected to heat and vibrations of the engine 8. Furthermore, assembly work can also be facilitated because the lever shift rod 49 and other components can be mounted prior to attachment of the shift actuator 32 to the actuator bracket 34.

As noted above, the actuator bracket 34 can formed as one piece in some embodiments. Accordingly, the shift actuator 32 and the actuator rod 36 can therefore be positioned easily and with high accuracy. In addition, cost can be reduced because the actuator bracket 34 can be manufactured to be smaller and can comprise fewer parts.

In addition, because the lever shift rod 49 can extend outwardly in the axial direction of the actuator rod 36, the bending stress exerted on the lever shift rod 49 can be minimized. Such an advantage can enhance the longevity of the lever shift rod 49.

According to another aspect of at least one of the embodiments, the shift shaft rotating mechanism can be used on an engine or outboard motor without changing the conventional layout of the engine or outboard motor. Indeed, the shift actuator 32 can be fitted along an outer area of the engine 8 within the cowling 5, and in particular, in the engine transverse direction and below the intake manifold 30. Further, the shift shaft 22 can be disposed on the widthwise center line of the outboard motor 1 and in front of the engine 8. The shift shaft 22 can thus be rotated by the lever shift rod 49, which can be a bow-shaped lever extending between the shift actuator 32 and the shift shaft 22 compactly along an interior of the motor 1. Therefore, changing the conventional layout of an engine is not required to implement certain embodiments of the shift shaft rotating mechanism. In addition, as mentioned above, dismounting/mounting work of the shift actuator 32 during maintenance is thus facilitated.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An outboard motor for transmitting engine power to a propeller to provide thrust to a watercraft, the motor comprising:

an exhaust guide being at least partially surrounded by a cowling of the motor, the exhaust guide being sized and configured to support an engine of the motor along a portion thereof, the exhaust guide comprising an opening connected with an exhaust pipe for guiding exhaust gases out of the engine;

a shift shaft being rotatably supported by the exhaust guide and extending substantially vertically downward from the exhaust guide;

a shift shaft rotating mechanism being attached to the exhaust guide and being sized and configured to selectively rotate the shift shaft; and a shifting mechanism arranged to switch a rotating direction of the propeller in response to the rotation of the shift; wherein the shift shaft is arranged to extend through the exhaust guide.

2. The outboard motor of claim 1, wherein the shift shaft rotating mechanism includes a shift actuator and an actuator bracket, the shift actuator and the actuator bracket each being connected to the exhaust guide, the shift actuator having an actuation member being selectively movable from a first position to a second position for rotating the shift shaft.

3. The outboard motor of claim 2, wherein the shift actuator further includes:

an actuator rod being connectable to and selectively moveable relative to the shift shaft; and a rod drive mechanism for advancing and retracting the actuator rod in an axial direction thereof.

4. The outboard motor of claim 3, wherein the actuator bracket includes a holder and a guide, the holder being disposed on a proximal end of the actuator bracket and being attachable to the rod drive mechanism for fixing a body of the shift actuator in a position relative to the actuator bracket, the guide being disposed at a distal end of the actuator bracket and extending in substantially the axial direction of the actuator rod, the guide being sized and configured for guiding and supporting the selective axial movement of the actuator rod.

5. The outboard motor of claim 3, wherein the shift shaft rotating mechanism further includes a lever shift rod having first and second ends, the first and second ends being at least indirectly connectable to the respective ones of the actuator rod and the shift shaft.

6. The outboard motor of claim 5, wherein the engine has an intake manifold attached to a side surface of the engine, and the shift actuator is disposed below the intake manifold; and the shift shaft is located on a widthwise center line of the outboard motor and in front of a drive shaft that transmits a driving force from the engine to the shifting mechanism.

7. The outboard motor of claim 5, wherein the shift shaft rotating mechanism further includes a shift arm fixed to an upper end of the shift shaft and extending horizontally therefrom, the shift arm being connectable to the lever shift rod for imparting movement of the actuator rod of the shift actuator to the shift shaft with a rotational axis of the shift shaft and a body of the shift actuator being in a fixed relative position.

8. The outboard motor of claim 5, wherein the lever shift rod is bow-shaped and extends along a side of the engine from the actuator rod toward a front surface of the engine toward the shift shaft, one end of the lever shift rod being rotatably attached to an end of the actuator rod, another end of the lever shift rod being rotatably attached to an end of the shift arm.

9. An outboard motor for facilitating shifting of a propeller to or from one of the forward and reverse rotating directions, the motor comprising:

an exhaust guide being at least partially surrounded by a cowling of the motor, the exhaust guide being sized and configured to support an engine of the motor along a portion thereof;

a shift shaft being rotatably supported by the exhaust guide and extending substantially vertically downward from the exhaust guide; and a shift shaft rotating mechanism being attachable to the exhaust guide and being sized and configured to selectively rotate the shift shaft, the shift shaft rotating mechanism including a shift arm and a shift actuator, the shift arm being at least indirectly connectable to the shift actuator, the shift arm being at least indirectly connectable to the shift shaft, the shift actuator being operative to move the shift arm between at least first and second positions for rotating the shift shaft;

wherein rotation of the shift shaft changes rotation of the propeller to or from one of the forward and reverse rotating directions; and wherein the shift shaft is arranged to extend through the exhaust guide.

10. The outboard motor of claim 9, wherein the shift actuator further includes:

an actuator rod being connectable to and selectively moveable relative to the shift shaft; and a rod drive mechanism for advancing and retracting the actuator rod in an axial direction thereof.

11. The outboard motor of claim 10, wherein the shift shaft rotating mechanism further comprises an actuator bracket, the actuator bracket including a holder and a guide, the holder being disposed on a proximal end of the actuator bracket and being attachable to the rod drive mechanism for fixing a body of the shift actuator in a position relative to the actuator bracket, the guide being disposed at a distal end of the actuator bracket and extending in substantially the axial direction of the actuator rod, the guide being sized and configured for guiding and supporting the selective axial movement of the actuator rod.

12. The outboard motor of claim 9, wherein the shift shaft rotating mechanism further includes a lever shift rod having first and second ends, the first and second ends being at least indirectly connectable to the respective ones of the actuator rod and the shift shaft.

13. The outboard motor of claim 12, wherein the shift shaft rotating mechanism further includes a shift arm fixed to an upper end of the shift shaft and extending horizontally therefrom, the shift arm being connectable to the lever shift rod for imparting movement of the actuator rod of the shift actuator to the shift shaft with a rotational axis of the shift shaft and a body of the shift actuator being in a fixed relative position.

14. The outboard motor of claim 12, wherein the lever shift rod is bow-shaped and extends along a side surface of the engine from the actuator rod toward a front surface of the engine toward the shift shaft, one end of the lever shift rod being rotatably attached to an end of the actuator rod, another end of the lever shift rod being rotatably attached to an end of the shift arm.

15. A shift shaft rotating mechanism for an outboard motor for facilitating shifting of a propeller to or from one of forward and reverse rotating directions, the outboard motor having a shift shaft being rotatably coupled to an exhaust guide of the motor, the mechanism comprising:

a body being attachable to the exhaust guide; an actuator for selectively rotating the shift shaft, the actuator being coupled to the body; and a shift arm having first and second ends, the first end being at least indirectly connectable to the actuator, the second end being at least indirectly connectable to the shift shaft;

wherein the actuator is operative to move the shift arm between at least first and second positions for rotating the shift shaft, rotation of the shift shaft causing rotation of the propeller to or from one of the forward and reverse rotating directions, and wherein the fixed relative positioning of the body of the shift shaft rotating mechanism and an axis of the shift shaft provides accurate shifting; and wherein the shift shaft is arranged to extend through the exhaust guide.

16. The shift shaft rotating mechanism of claim 15, wherein the actuator further includes:

an actuator rod being connectable to and selectively moveable relative to the body; and a rod drive mechanism for advancing and retracting the actuator rod in an axial direction thereof.

17. The shift shaft rotating mechanism of claim 16, further comprising an actuator bracket, the actuator bracket including a holder and a guide, the holder being disposed on a proximal end of the actuator bracket and being attachable to the rod drive mechanism for fixing the body of the shift shaft rotating mechanism in a position relative to the actuator bracket, the guide being disposed at a distal end of the actuator bracket and extending in substantially the axial direction of the actuator rod, the guide being sized and configured for guiding and supporting the selective axial movement of the actuator rod.

18. The shift shaft rotating mechanism of claim 16, further comprising a lever shift rod having first and second ends, the first and second ends being at least indirectly connectable to the respective ones of the actuator rod and the shift shaft.

19. The outboard motor of claim 18, wherein the shift shaft rotating mechanism further includes a shift arm fixed to an upper end of the shift shaft and extending horizontally therefrom, the shift arm being connectable to the lever shift rod for imparting movement of the actuator rod of the shift actuator to the shift shaft.

20. The outboard motor of claim 18, wherein the lever shift rod is bow-shaped and extends along a side surface of the engine from the actuator rod toward a front surface of the engine toward the shift shaft, one end of the lever shift rod being rotatably attached to an end of the actuator rod, another end of the lever shift rod being rotatably attached to an end of the shift arm.

* * * * *